United States Patent [19]

Vuilleumier

[11] Patent Number: 4,974,242

[45] Date of Patent: Nov. 27, 1990

[54] CALENDAR WATCH HAVING A CENTRALLY PIVOTED DATE INDICATOR

[75] Inventor: Cyril Vuilleumier, Bienne, Switzerland

[73] Assignee: ETA SA Fabriques d'Ebauches, Grenchen, Switzerland

[21] Appl. No.: 417,892

[22] Filed: Oct. 6, 1989

[30] Foreign Application Priority Data

Oct. 10, 1988 [CH] Switzerland ..... 03771/88

[51] Int. Cl.[5] ..... G04B 19/24

[52] U.S. Cl. ..... 368/37

[58] Field of Search ..... 368/28, 31–38

[56] References Cited

U.S. PATENT DOCUMENTS

| | | | |
|---|---|---|---|
| 3,628,322 | 12/1971 | McDuffee | 368/28 |
| 3,683,614 | 8/1977 | Komiyama | 368/38 |
| 3,859,783 | 1/1975 | Wuthrich | 368/38 |
| 3,882,669 | 5/1975 | Jakob | 368/38 |
| 4,443,112 | 4/1984 | Stotz et al. | 368/37 |
| 4,611,925 | 9/1986 | Vuilleumier | 368/28 |

FOREIGN PATENT DOCUMENTS

| | | |
|---|---|---|
| 1031926 | 6/1953 | France . |
| 35166 | 7/1967 | Switzerland . |
| 661170 | 7/1987 | Switzerland . |
| 168382 | 8/1921 | United Kingdom . |

*Primary Examiner*—Vit W. Miska

*Attorney, Agent, or Firm*—Griffin Branigan & Butler

[57] ABSTRACT

A calendar watch includes a central date indicator (4). The indicator is united with a crown wheel (9) comprising teeth (11) forming a circular crown (12) arranged to be perpendicular to a face (13) of said wheel. The teeth (12) are driven by a finger (14) rotating in a plane intersecting said crown in its height. The finger is united with a date driving wheel (15). The invention permits easy transformation of a watch having its date display in a dial aperture to a watch having a date indicator rotating about the center of the movement.

5 Claims, 3 Drawing Sheets

CALENDAR WATCH HAVING A CENTRALLY PIVOTED DATE INDICATOR

This invention concerns a calendar watch including movement adapted to display at least hours, minutes and a date by means of indicators rotating over a dial and turning about the center of the movement, and a crown wheel united with the date indicator, the teeth of said crown wheel forming a circular crown arranged to be perpendicular to a face of said wheel.

BACKGROUND OF THE INVENTION

It has already been suggested to drive a central date indicator by a crown wheel by means of which one may add the date indication to a standard watch without the necessity of effecting important modifications to an existing movement. Swiss patent document No. CH-A-332 898 shows such a construction.

The arrangement as described calls for a mechanism arranged entirely above the dial, this having the disadvantage of increasing considerably the thickness of the watch. This same arrangement also calls for an elastic blade united with the pipe of the hours wheel which every twelve hours is lifted by a dog fixed to the dial in order to bring the free end of said blade into mesh with the teeth of the crown wheel, thus causing said crown wheel to advance by one step along with the date indicator which is fixed thereto. Such mechanism requires a substantial turning moment at the instant of driving of the indicator, such being ill advised for a watch driven by a stepping motor itself energized by a battery. Furthermore one may reasonably fear jamming of the crown wheel on the hour wheel pipe at the moment that the indicator is to be advanced.

In modern calendar watches, the date is indicated most often by means of a ring on which are inscribed figures 1 to 31 appearing in an aperture provided in the dial. Nowadays there is a strong demand, claiming once again the date display by means of a central hand rotating over an hours circle showing thirty-one divisions as was the case in ancient calendar watches. One may thus be tempted to adapt a mechanism foreseen for driving a date ring in a manner such that it may drive a central hand and this, as far as possible, in adding to the mechanism a minimum of modification.

Such an attempt is described in Swiss patent document No. CH-A-661 170. In this document the date indicating hand faces a fixed date circle appearing at the periphery of the dial and is borne by a pipe of a plate coaxial to the center of the movement on which is set a coupling piece exhibiting three elastic arms snap engaged with the heads of studs borne by the date ring.

The construction which has just been briefly described maintains use of the date ring (furthermore driven in a standard manner), this necessitating, in addition to manufacture of the connection piece with three arms, a special preparation of the ring as well as the manufacture of relatively complicated studs in order to couple such ring to the connection piece. Furthermore, the mere presence of the mentioned studs leads to a construction which assumes a certain thickness in addition to the thickness necessary for the development of the connection piece which is superposed.

SUMMARY OF THE INVENTION

The calendar watch of this invention is likewise constructed on the basis of a date mechanism using a dial aperture where the date ring is suppressed and is replaced in a certain manner by the teeth of a crown wheel. The watch is characterized by the fact that said teeth are periodically driven by a finger rotating in a plane intersecting the circular crown formed by the teeth, in the height thereof, said finger being united with a date driving wheel having an axis parallel to the axis of said crown wheel, and by the fact that a jumper spring is arranged between two adjacent teeth in order to position the date indicator when said indicator is at rest.

The advantages of this construction will appear with reading of the description to follow, such description being illustrated by way of example by the drawings attached hereto.

DESCRIPTION OF THE PREFERRED EMBODIMENT

Figure 1:
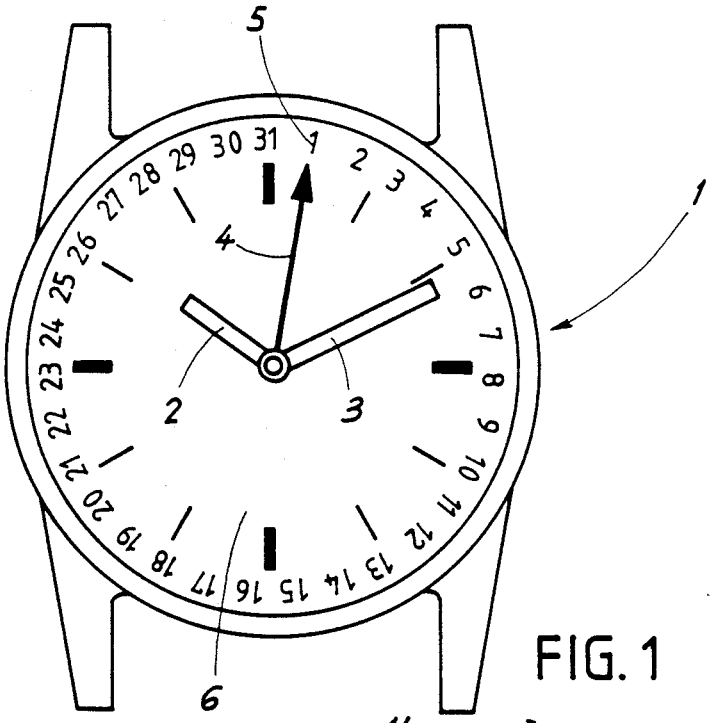
FIG. 1 is a plan view of a calendar watch with a central date indicator.

The plan view of FIG. 1 shows a calendar watch 1 with hours hand 2, minutes hand 3 and a date hand 4 which is displaced facing date markers 5 fixed to a dial 6. The indicators 2, 3, 4 turn at the center of a movement placed under the dial.

Figure 2:
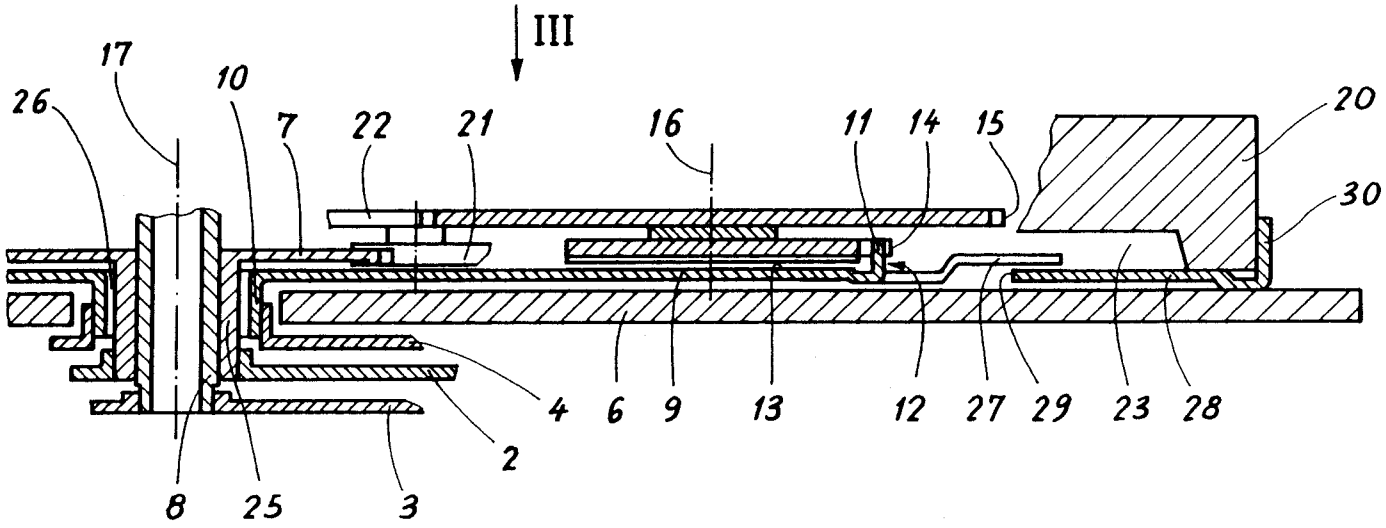
FIG. 2 is a partial cross-section in the calendar watch according to the invention in which appears the date indicator and its driving mechanism, such cross-section being along line II—II of FIG. 3.

The cross-section of FIG. 2 shows the hours hand 2 and the minutes hand 3. A seconds hand, not shown, may complete the display system FIG. 2 shows further an indicator or date hand 4 turning at the center of the movement and driven by a mechanism which forms the object of this invention.

The date indicator 4 is united with a crown wheel 9. The crown wheel 9 which is visible in plan view on FIG. 3 according to arrow III on FIG. 2 includes teeth 11 which form a circular crown 12, said crown being arranged perpendicular to face 13 of the crown wheel 9.

Figure 3:
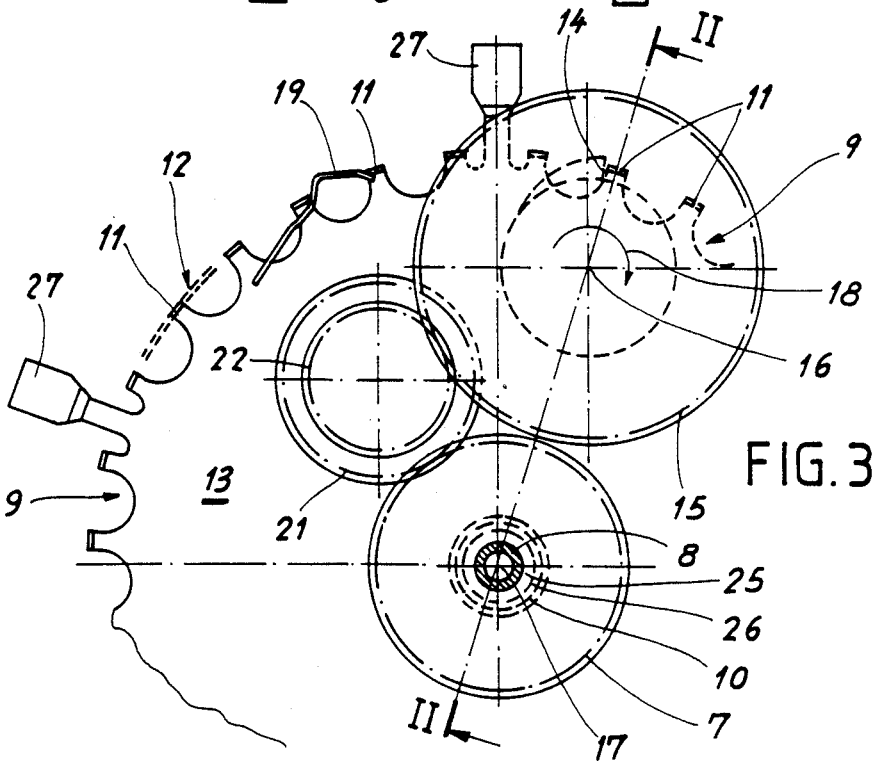
FIG. 3 is a partial plan view according to arrow III of FIG. 2.

As may be seen on FIGS. 2 and 3 and in accordance with an important feature of the invention, teeth 11 of the crown wheel 9 are periodically driven by a finger 14 which rotates in a plane intersecting crown 12 in the height thereof. Thus, as clearly appears on FIG. 2, finger 14 remains confined to the interior of the cup formed by face 13 and crown 12 of wheel 9.

Finger 14 is united with a date driving wheel 15 which has an axis 16 parallel to the axis 17 of the crown wheel 9. Thus, when finger 14 drives a tooth 11 in the sense of arrow 18, the crown wheel 9 and with it the indicator 4 are driven through one step in the same sense. The displacement angle corresponds to 360° divided by the number of teeth which are found on the crown wheel. A jumper spring 19 bearing at rest on two successive teeth forces the wheel to adopt equidistant rest positions.

In the example shown on FIG. 3, the crown wheel 9 comprises thirty-one teeth 11. If the driving wheel 15 makes one rotation in 24 hours, it will be understood that the date indicator will indicate the date or in other terms the ordinal number of each day in the month. However, the invention is not limited to date indications. It could also show days of the week, the month, the year, phases of the moon or even signs of the zodiac.

In the case where the calendar watch includes a base plate 20, which is only indicated on FIG. 2, such base plate bears the watch mechanism and in particular the drive wheel 15 with its finger 14 and the hours wheel 7. The hours wheel could drive directly the date drive wheel. In the example shown on FIGS. 2 and 3 however, an intermediate mechanism comprising two integral and coaxial gears respectively referenced 21 and 22 is interposed between the hours pipe 7 and the date drive wheel 15.

In calendar watches in which the date appears in a dial aperture, the date ring is housed in a circular channel provided at the periphery of the base plate. In the embodiment of this invention as shown, the channel has been maintained but the date ring has been eliminated. This appears best on FIGS. 4 and 5 which are respectively a cross-section and a plan view taken at a location different from that shown on FIG. 2, this latter figure being above all for the purpose of showing how the crown wheel is driven.

Figure 4:
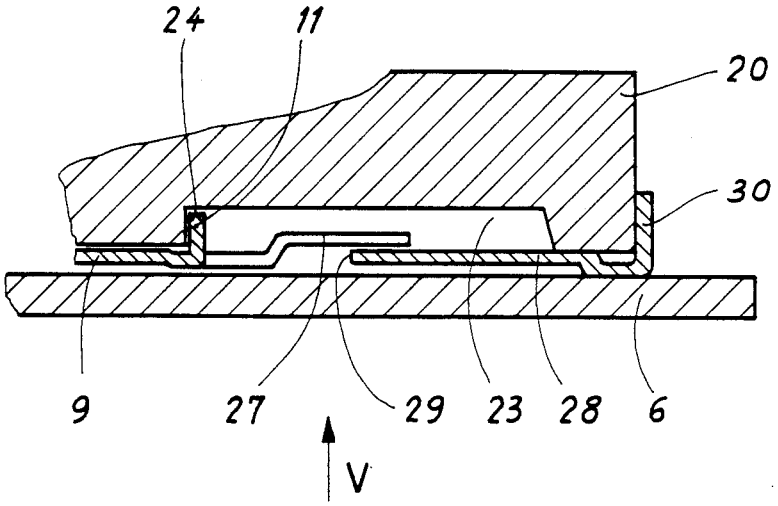
FIG. 4 is a partial cross-section of the calendar watch according to the invention, such cross-section being taken at a different place than that shown on FIG. 2 and along line IV—IV of FIG. 5.
Figure 5:
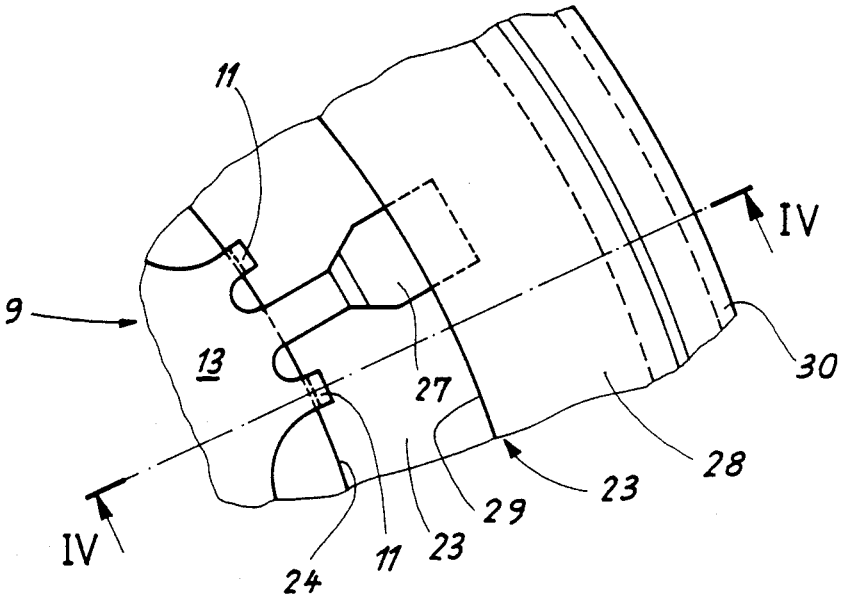
FIG. 5 is a partial plan view according to arrow V of FIG. 4.

FIG. 4 shows channel 23 which serves to house a date ring in a watch in which the date appears through a dial aperture. The channel is provided in the base plate 20 and is covered by the dial 6. This channel may accommodate the teeth 11 of the crown wheel 9. Such teeth are freely adjusted to the smaller diameter edge 24 shown by said channel. This adjustement enables centering and guiding of the crown wheel relative to the center of the movement. FIG. 5 which is a plan view according to arrow V of FIG. 4 (the dial has been removed), shows well the circular appearance of channel 23 and how the interior edge of the teeth 11 rests on the edge 24 of said channel.

Reverting to FIG. 2, one will see that the hours wheel 7 is provided with a first pipe 25 on which is pressed the hours hand 2. The pipe 25 turns freely on the cannon pinion 8 which bears the minutes hand 3. Wheel 7 and cannon pinion 8 are coupled together by means of a standard wheel train (not shown). The crown wheel 9 is situated immediately under dial 6 and is equipped with a second pipe 10 raised in its center and on which is driven the date indicator 4. The figure shows that clearance 26 is provided between the first and second pipes. This clearance enables the avoidance of all jamming between said pipes, above all at the moment when the crown wheel is driven. This clearance is made possible in view of the fact that the teeth of the crown wheel serve to center the wheel as has been mentioned hereinabove.

Thus according to the description which has just been given of the invention, it is quite simple to transform a movement having a standard date mechanism intended for display through an aperture into a movement having a date indicating hand rotating about the center. After having removed the date ring from the movement, one may set the crown wheel onto the hours pipe, then the dial is set into place in arranging between such dial and the base plate a sleeve, the height of which will be slightly greater than the thickness of the crown wheel. It is to be noted that the date drive wheel with its finger does not have to be modified if the teeth of the crown wheel fall at the same place as the teeth of the date ring. It should also be arranged that the form of such teeth be the same.

There remains to be described a non-essential characteristic of the invention, but which however improves it still further.

FIGS. 2 to 5 show that the crown wheel includes a plurality of tabs 27 which extend beyond the peripheral crown 12 shown by the teeth 11. FIGS. 2, 4 and 5 show also a cover 28 which caps the periphery of the base plate 20 in extending partially over the circular channel 23 to the interior edge 29 of said cap. The cover will be preferably fashioned in a manner such that it will clamp the base plate by its flange 30. The figures show that cover 28 forms with channel 23 an annular housing in which the tabs 27 of the crown wheel may move. This construction enables fulfilling several functions at the same time: the cover serves as spacer ring between the base plate and the dial and the tabs maintain the crown wheel at its proper height in avoiding that it come into contact with the dial. Finally, this arrangement enables the manufacturer to offer a complete movement even before placing of the dial, this facilitating handling thereof.

The description which has just been given is based on a calendar watch provided with a base plate, itself having a circular channel in which the teeth of a crown wheel are accommodated in place of a date ring. However, watches are known which have no base plate but which are provided with a date ring. It will be understood that this invention may likewise be applied to such watches by analogous construction methods.

What I claim is:

1. A calendar watch including a movement adapted to display at least hours, minutes and a date by means of indicators rotating over a dial and turning about the center of the movement and a crown wheel united with the date indicator, the teeth of said crown wheel forming a circular crown located on the outer edge of said wheel and perpendicular to a face thereof, said teeth being driven periodically by a finger rotating in a plane intersecting said crown in the height thereof, said finger being united with a date drive wheel having its axis parallel to the axis of the crown wheel, said movement including a base plate in the periphery of which is set a circular channel into which the teeth of the crown wheel penetrate, said channel being limited by first and second coaxial edges, the diameter of the first edge being smaller than the diameter of the second edge, said teeth sliding freely along said first edge so as to center and guide the crown wheel relative to the center of the movement.

2. A calendar watch as set forth in claim 1 wherein said crown wheel includes 31 teeth and said date drive wheel makes one rotation in 24 hours.

3. A calendar watch as set forth in claim 1 wherein said base plate bears a mechanism comprising at least an hours wheel with a first pipe onto which an hours hand is pressed, said crown wheel being located directly under the dial and having at its center a second pipe rotating with clearance around said first pipe, and a date hand affixed to said second pipe.

4. A calendar watch as set forth in claim 3 wherein the crown wheel includes a plurality of tabs extending beyond the circular crown and wherein a cover caps the periphery of the base plate and extends partially over said circular channel so as to form an annular housing within which said tabs move thereby to maintain said crown wheel at its proper height in the movement.

5. A calendar watch as set forth in claim 3 wherein said date drive wheel is driven by said hours wheel through intermediate wheels.

* * * * *